United States Patent [19]

McLean

[11] 3,946,485

[45] Mar. 30, 1976

[54] POWER OPERATED CAN OPENER WITH POWER-PIERCE, AUTOMATIC SHUTOFF, AND REMOVABLE OPERATING LEVER AND CUTTER MOUNTING PLATE ASSEMBLY

[76] Inventor: Robert E. McLean, c/o Rival Manufacturing Company, 36th and Bennington, Kansas City, Mo. 64129

[22] Filed: May 23, 1975

[21] Appl. No.: 580,419

Related U.S. Application Data

[63] Continuation of Ser. No. 478,920, June 13, 1974, abandoned.

[52] U.S. Cl. ..... 30/4 R

[51] Int. Cl.[2] ..... B67B 7/38

[58] Field of Search ..... 30/4 R, 8, 8.5, 9, 14, 30/15, 15.5

[56] References Cited

UNITED STATES PATENTS

| | | | |
|---|---|---|---|
| 3,689,997 | 9/1972 | McLean | 30/4 R |
| 3,724,069 | 4/1973 | McLean | 30/4 R |
| 3,736,659 | 6/1973 | McLean | 30/4 R |

*Primary Examiner*—Al Lawrence Smith
*Assistant Examiner*—Gary L. Smith

[57] ABSTRACT

An electrically powered can opener with power-pierce and automatic shutoff has a permanently assembled (together) combination cutter mounting plate and operating lever that is selectively removable from its operating position upon the can opener frame. The cutter mounting plate and operating lever combination is secured in position on the frame by three strategically located bosses that assures a holding force is exerted at points advantageous for maintaining good alignment of the cutter mounting plate at all times. The removal and reinstallation of the cutter mounting plate and operating lever is easily accomplished by the manipulation of a spring biased push button latch. An integral lever pivots upon the back of the frame and contacts the switch to cause energization of the motor for cutting the can lid and automatic deenergization when the lid has been completely severed from the can. The minimization of friction between the cooperating affected parts allows a small spring to cause the integral lever to pivot and automatically deenergize the motor when the can cutting is completed. A resilient can guide extends from the frame at a point exterior to the cutter mounting plate to assist in properly engaging the can. This movable can guide cooperates with the cutter wheel and a fixed can guide extending from the cutter mounting plate, while not interfering with the automatic shutoff.

2 Claims, 8 Drawing Figures

POWER OPERATED CAN OPENER WITH POWER-PIERCE, AUTOMATIC SHUTOFF, AND REMOVABLE OPERATING LEVER AND CUTTER MOUNTING PLATE ASSEMBLY

This is a continuation of application Ser. No. 478,920, filed June 13, 1974, and now abandoned.

BACKGROUND AND BRIEF DESCRIPTION OF THE INVENTION

My invention relates generally to an electrically powered can opener and more particularly to a can opener including power-pierce, automatic shutoff, and an easily removable cutter mounting plate and operating lever assembly. The power-pierce structure and associated features have been disclosed in U.S. Pat. No. 3,314,144 (issued Apr. 18, 1967) and the removability of the cutting element by utilizing push button latches has been discussed in U.S. Pat. Nos. 3,689,997 (issued Sept. 12, 1972) and 3,724,069 (issued Apr. 3, 1973). The can opener described later is an improvement over the 3,689,997 and 3,724,069 patents.

An upright frame is suitably apertured to receive a pin member that extends from the operating lever. Permanently pivoted to the operating lever is the cutter mounting plate, which carries the cutting element. A tapered end stud extends from the cutter mounting plate through preferably an oblique rectangular opening in the frame to engage the power-pierce mechanism. The combined operating lever and cutter mounting plate are removably pivoted to the front of the frame, with a push button latch serving to engage the pin member adjacent the frame's rear side.

A spring biased resilient can guide extends forwardly from the frame to firmly hold the engaged can upon the toothed can feed wheel prior to both the power-pierce and to contact of the can with a fixed can guide mounted on the cutter mounting plate. As the operating lever is moved downwardly, it effects a similar movement of the cutter mounting plate. Since the cutting element contacts the end of the can before piercing same, the cutter mounting plate is caused to pivot clockwise. This pivotal movement moves the attached tapered end stud downwardly and in turn pivots a spring biased integral lever to cause energization of the motor prior to the piercing of the can. The spring biasing of the integral lever causes it to pivot to its stable position when the cutting of the can has been completed. The resilient can guide is located at a distance from the cutter mounting plate so as to entirely disassociate its operation with that of the cutter mounting plate.

A primary object of my invention is to provide a power operated can opener with power-pierce and automatic shutoff that includes a novel and inexpensive structure which comprises the permanently assembled (together) removable operating lever and cutter mounting plate.

An object of my invention is to provide a unique structure that permits the proper securement and removability without tools of the combined operating lever and cutter mounting plate relative to the remainder of the can opener.

Another object is to provide a uniquely constructed can opener including a permanently assembled operating lever and cutter mounting plate that can be more easily reinstalled and more economically produced than known prior art units.

Another object of the invention is to provide in a power operated can opener with automatic shutoff, unique structure for further reducing friction between the cooperating affected parts. It is a feature of this object that such structure permits the use of spring means of substantially less force for accomplishing movement of the parts to effect automatic shutoff. Consequently, less downward force is required on the operating lever of the can opener to operate an associated knife sharpener.

Yet another object is to provide in a power operated can opener with automatic shutoff an essentially free upward swinging of the operating lever from its horizontal rest position to its uppermost position when a can is not engaged in the can opener. It is a feature of this invention that frictional drag between cooperating parts has been substantially reduced over known prior art devices to permit the above described free upward swinging.

A further object of the invention is to provide for the pivoting of the resilient can guide to the frame of a power operated can opener of the character described in such manner that the can guide's connection and physical operation with the cutter mounting plate is entirely disassociated.

A still further object is to provide in a power operated can opener of the character described, three bosses which are strategically located and upon which the cutter mounting plate seats so that camming of the latch exerts force at most advantageous points for efficiently aligning the cutter mounting plate and the frame regardless of any possible operating position of the cutter mounting plate.

Another object of my invention is to provide a unique power operated can opener wherein the rate of piercing of the end of the can by the cutter wheel, in cooperation with the power-pierce arrangement, accomplishes the power-pierce with a minimum of manual force on the operating lever.

Yet another object of the invention is to provide a unique power operated can opener wherein the path of movement of the cutter wheel, as it pierces the end of the can, cooperates most efficiently with the power-pierce arrangement, thereby accomplishing the piercing of the can with a minimum of manual force on the operating lever.

Other and further objects of the invention, together with the features of novelty appurtenant thereto, will appear in the course of the following description.

DETAILED DESCRIPTION OF THE INVENTION

In the accompanying drawings, which form a part of the specification and are to be read in conjunction therewith and in which like reference numerals are employed to indicate like parts in the various views.

Figure 1:
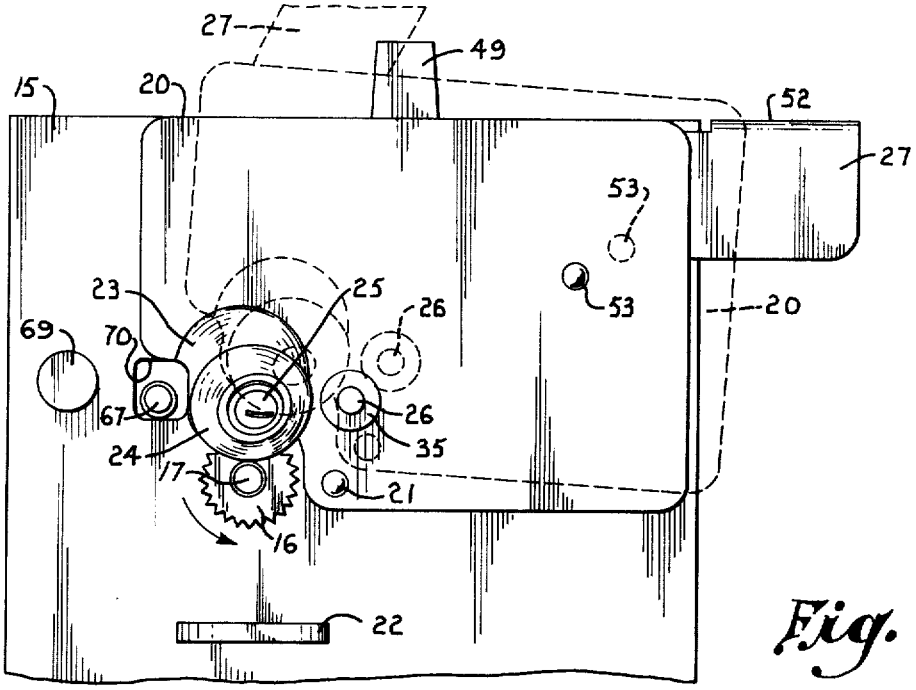
FIG. 1 is a front elevational view of the upper portion of the can opener, with broken lines showing the uppermost position of the cutter mounting plate and operating lever.
Figure 2:
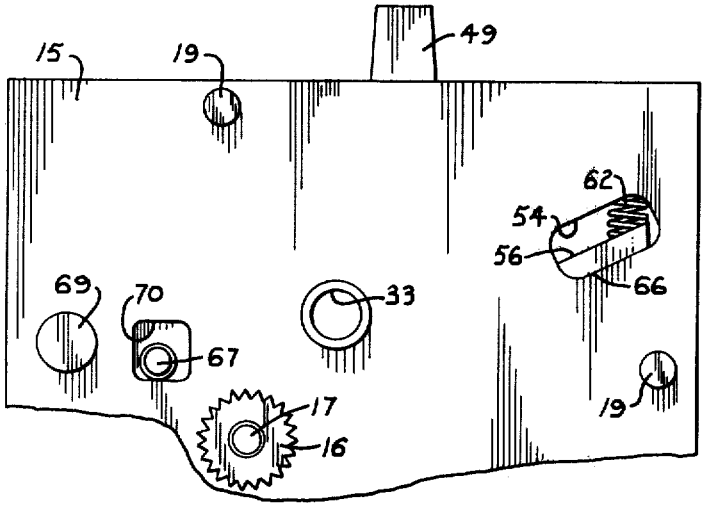
FIG. 2 is a front elevational view of the upper portion of the can opener with the cutter mounting plate and operating lever removed.

Turning now to the drawings, reference numeral 15 generally designates the upright frame of the can opener. Frame 15 is designed to be utilized with a box-like casing (not shown) to enclose the operating mechanisms supported on the rear surface thereof. Can feed wheel 16 is threaded onto can feed wheel drive shaft 17. The drive shaft 17 is journalled for rotation in a fixed boss 18 (which preferably is integral with frame 15), and suitable reduction gearing is utilized to power drive shaft 17 by means of a conventional electric motor M, preferably of the economical shaded pole type.

Frame 15 is provided with two small integral bosses 19 that extend forwardly of the general front surface of the frame, and against which the cutter mounting plate 20 seats. A third small boss 21 of the same height as bosses 19 is anchored in cutter mounting plate 20. When the can opener is assembled, bosses 19 and 21 maintain cutter mounting plate 20 a spaced distance from, and parallel to, frame 15. Frame 15 is also provided with a conventional can guard 22. Cutter mounting plate 20 is provided with a compound angled boss 23, in which a suitable cutter stud or arbor is anchored. Cutter wheel 24 is journalled on this stud or arbor and maintained thereon by washer head screw 25. Cutter wheel 24 can have limited wobble movement, as shown in U.S. Pat. No. 3,314,144 (issued Apr. 18, 1967).

Figure 3:
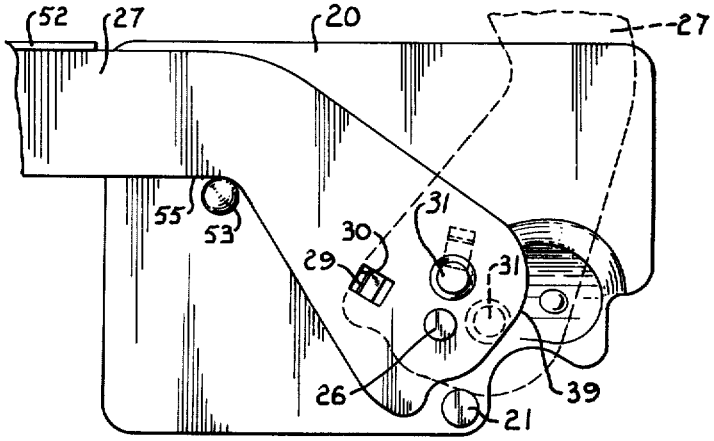
FIG. 3 is a rear elevational view of the removed cutter mounting plate and operating lever, with broken lines showing the raised position of the operating lever.

Operating lever 27 is pivoted to cutter mounting plate 20 by fixed can guide 26. A spacer plate 28 is interposed between cutter mounting plate 20 and operating lever 27. Spacer plate 28 is provided with a rearwardly turned lug 29 (FIG. 3), which engages in an opening 30 of operating lever 27 to prevent rotation of spacer plate 28 with respect to operating lever 27. A latch stud 31 is preferably hot-headed into lever 27, and extends rearwardly through hole 33 of boss 45 (see FIG. 5), which is integral with frame 15. After latch stud 31 has been secured to lever 27, this assembly, together with spacer plate 28, is pivoted to cutter mounting plate 20, preferably by hot-heading the tenon portion of fixed can guide 26. Spacer plate 28 is provided with a clearance hole (not shown) that receives the hot-head of latch stud 31. When assembled, cutter mounting plate 20 will freely pivot on fixed can guide 26 between its flanged portion 35 and spacer plate 28.

When assembled on the can opener, the upper edge of operating lever 27 engages upper boss 19 of frame 15 to limit the counterclockwise (when viewed from the front) swinging of lever 27. When lever 27 and cutter mounting plate 20 are removed from frame 15, portion 39 (FIG. 3) of spacer plate 28 and lever 27 engages boss 21 to limit the counterclockwise swinging of lever 27, such permissible swinging being a few additional degrees to that permitted by the upper boss 19 when the assembly is attached to the can opener.

Figure 7:
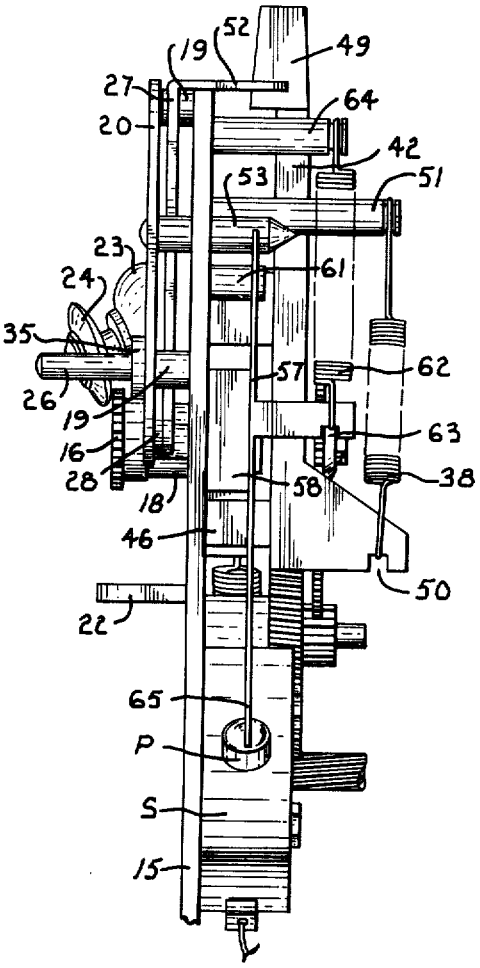
FIG. 7 is a side elevational view taken from the right side of FIG. 1.
Figure 8:
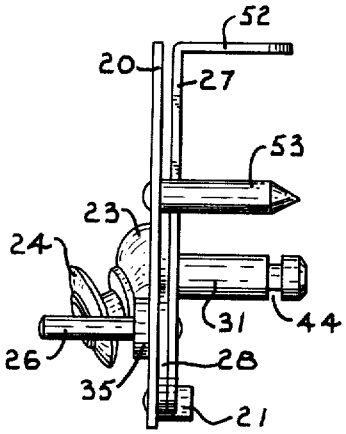
FIG. 8 is a side elevational view of the removed cutter mounting plate and operating lever taken from the left side of FIG. 3.

A push button operated latch 42 seats on bosses 45 and 46 of frame 15, and has a shoulder screw 40 extending through slot 47 of latch 42 to freely fasten the lower end of latch 42 to boss 46. When the permanently assembled (together) operating lever 27 and cutter mounting plate 20 are in place on the remainder of the can opener, with the narrow portion of a keyhole shaped opening 43 of latch 42 fitting into a groove 44 (FIG. 8) of latch stud 31, the operating lever-cutter mounting plate assembly is drawn rearwardly by the action of rise cams 41 as latch 42 is urged upwardly by a tension spring 38. As shown in FIG. 7, one end of spring 38 is hooked in notch 50 of latch 42, while the other end is hooked on a stud 51 which extends rearwardly from frame 15. Rearward projection 48 of boss 45 limits movement of the upper end of latch 42 to the right (as viewed from the rear) when lever 27 and cutter mounting plate 20 are removed from the can opener. Latch 42 is provided with a knob 49 that extends freely through a suitable opening in the casing of the can opener and operates similarly to those disclosed in U.S. Pat. Nos. 3,496,635 (issued Feb. 24, 1970) and 3,250,056 (issued July 14, 1970).

A tapered end stud 53 is hot-headed in cutter mounting plate 20 near the right edge of the plate and extends rearwardly through a generally rectangular opening 54 of frame 15. Clockwise rotation (as viewed from the front) of operating lever 27 relative to cutter mounting plate 20 is limited by engagement between stud 53 and the under-edge portion 55 of lever 27. When the parts are in this rest position (with portion 55 engaging stud 53, see FIGS. 3, 4 and 5), tapered end stud 53 seats on upper portion 56 of a bellcrank shaped switch control lever 57. Switch control lever 57 is pivoted to boss 58 of frame 15 by a shoulder rivet 59. Clockwise swinging of control lever 57 (as viewed from the rear) is limited by engagement of portion 60 of its upper edge with boss 61 of frame 15. One end of a tension spring 62 is hooked is notch 63 of lever 57, while the other end is hooked on boss 64 of frame 15. It should be noted that whenever portion 60 of control lever 57 seats against stop boss 61, portion 56 of control lever 57 substantially parallels the upper and lower edges of rectangular opening 54. Furthermore, when the parts are in such position, and tapered end stud 53 seats on portion 56 of lever 57, there is a few thousandths of an inch clearance between stud 53 and the upper edge of opening 54 to permit free insertion of stud 53 into opening 54 and free removal therefrom.

Switch control lever 57 has a depending leg 65 for engagement with the plunger P of a conventional switch S, the contact points of which are biased to the open or "off" condition. From the rest position shown in solid lines in FIG. 1, operating lever 27 and cutter mounting plate 20 can be unitarily rotated approximately 4° clockwise (as viewed from the front) on the axis of latch stud 31. When so rotated, stud 53 seats on the lower edge 66 of opening 54 (as shown by the broken lines in FIG. 4), thereby pivoting switch control lever 57 about shoulder rivet 59 and causing switch S to energize the motor. (Of course, the switch S is in series with motor M.) Stud 53 never engages the ends of opening 54 when in any operating position. Although the long axis of opening 54 may be at any desired angle, it has been found that an angle of approximately 25° from horizontal results in the easiest piercing of the object can when the other selected parameters are as shown.

A resilient can guide 67 is anchored in link 68 (preferably by hot-heading process). The link 68 is pivoted to the rear of frame 15 by a shoulder rivet 69 so that can guide 67 may extend forwardly through an opening 70 in frame 15. One end of a tension spring 74 is hooked in hole 71 of leg 72, which is integrally formed with link 68. The other end of spring 74 is hooked on boss 73 of frame 15, thus always urging can guide 67 toward its seat on the lower edge of opening 70. Finally, operating lever 27 has the horizontal portion 52 by which the user manipulates the lever.

OPERATION

The wedging action of rise cams 42 (straddling latch stud 31) causes latch 42 to draw stud 31 and operating lever 27 rearwardly. Since the cutter mounting plate 20 is pivotally fastened to operating lever 27 by fixed can guide 26, cutter mounting plate 20 is likewise drawn rearwardly at the location of can guide 26, which is well within the triangle defined by bosses 19 and 21. Such action maintains firm and proper alignment of cutter mounting plate 20 relative to frame 15.

To open a can, the user first swings the operating lever 27 counterclockwise (as viewed from the front) until its upper edge engages upper boss 19 of frame 15. Cutter mounting plate 20 is then in the position shown by broken lines in FIG. 1, cutter wheel 24 being separated from can feed wheel 16 to allow insertion of a can. The can is inserted in the customary manner, with the end of the can bearing upwardly in engagement with the periphery of cutter wheel 24, and with the flange of the can below can guides 67 and 26 and over the toothed periphery of feed wheel 16. Operating lever 27 is then swung clockwise to its extreme position. (After swung to such position, the user need not continue holding lever 27). When the end has been sheared from the can, the motor shuts off automatically, but the can continues to be held by the can opener until such time as the user wishes to release it. Release of the can is accomplished by again swinging lever 27 to its extreme counterclockwise position, whereby cutter wheel 24 is again separated from feed wheel 16. For appearance or storage purposes, lever 27 is normally swung to its usual horizontal rest position.

While a can is being opened as stated above, the parts of the can opener operate as now described. When operating lever 27 is in its extreme counterclockwise (from the front) position and a can is inserted, the flange of the can seats downwardly on the toothed periphery of feed wheel 16. The flange of the can is in upward engagement with resilient can guide 67, and there is some clearance between the flange of the can and fixed can guide 26. At this position, stud 53 remains seated on surface 56 of switch control lever 57. Likewise, edge portion 60 of lever 57 remains in engagement with stop boss 61. As operating lever 27 is swung downwardly several degrees, the periphery of cutter wheel 24 contacts the end of the can before the flange of the can is engaged by fixed can guide 26. This is a most desirable feature of the invention, since the loading of the can guides ahead of engagement of the end of the can by cutter wheel 24 tends to urge the flange of the can off the toothed periphery of feed wheel 16, due to the fact that can guides 26 and 67 engage the flange of the can at points defining a line offset forwardly from the plane of the face of feed wheel 16. Engagement of the can end by cutter wheel 24 before it is engaged by fixed can guide 26 eliminates this tendency and maintains the flange of the can firmly on can feed wheel 16.

Figure 4:
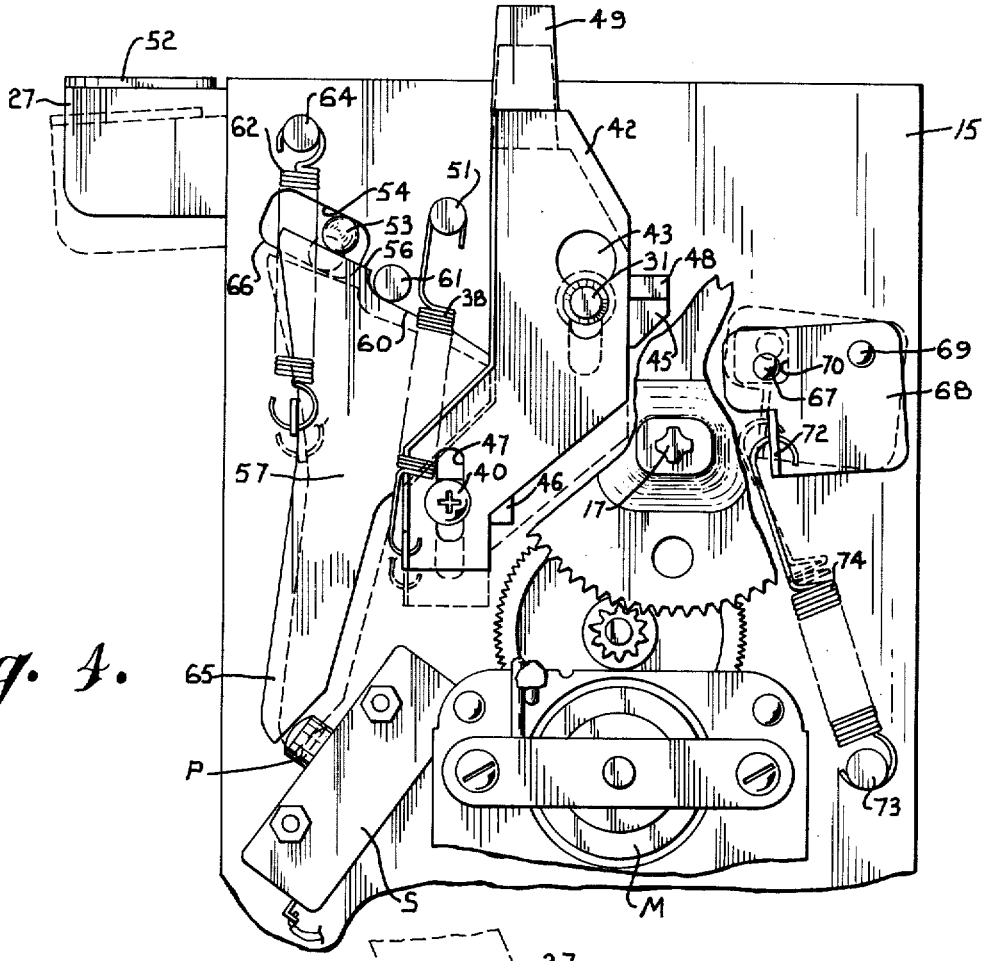
FIG. 4 is a rear elevational view of the can opener frame and associated supported components located thereon, the broken lines showing the depressed position of the latch, and with the operating lever shown in broken lines with the power-pierce and automatic shut-off mechanism to indicate the motor energizing position.
Figure 5:
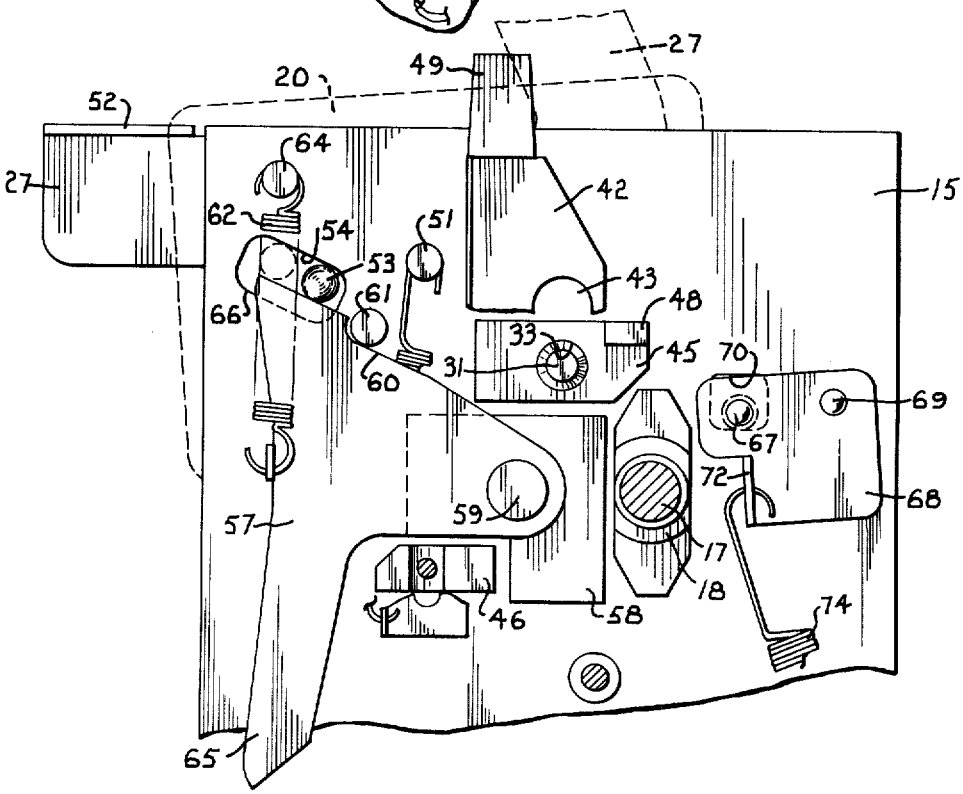
FIG. 5 is a view similar to the upper portion of FIG. 4, with the gears and a portion of the latch removed, and with the operating lever, cutter mounting plate, and tapered end stud shown in broken lines in the can receiving (or removing) position.
Figure 6:
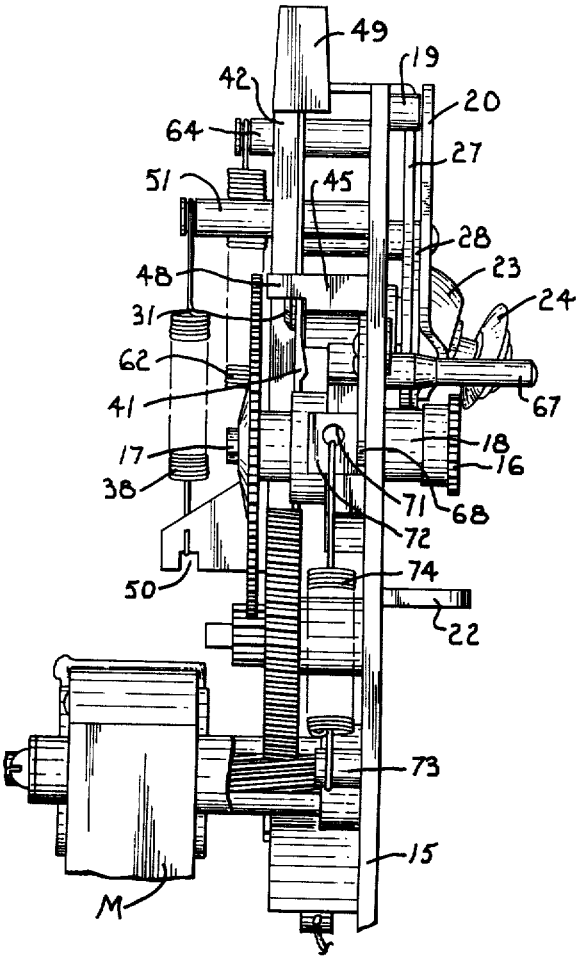
FIG. 6 is a side elevational view taken from the left side of FIG. 1.

The swinging of operating lever 27 downwardly a few additional degrees causes cutter wheel 24 to temporarily fulcrum on the end of the can as fixed can guide 26 engages the flange of the can. Since the can is not yet pierced, the clockwise torque (as viewed from the front) applied to cutter mounting plate 20 by the force of the end of the can on cutter wheel 24 causes plate 20 to pivot about fixed can guide 26. The pivotal motion of plate 20 results in the attached stud 53 moving to the lower edge 66 of frame opening 54. This downward motion of stud 53 rotates switch control lever 57 counterclockwise (as seen in FIGS. 4 and 5), thereby changing switch S from its "off" condition to its "on" condition and energizing motor M.

At this point in time, the energized motor M is causing the can to be fed by feed wheel 16, although the can has not yet been pierced. Further downward motion of operating lever 27 to its extreme position (shown by the broken lines in FIG. 4) results in the power-piercing of the can end by cutter wheel 24 and in the upward movement of resilient can guide 67, against the tension of spring 74. The axis of the can is then approximately 4° clockwise from vertical, or perpendicular to the top edge of cutter mounting plate 20. While the end is being sheared from the can, thrust resulting from resistance of the end of the can to shear by cutter wheel 24 overcomes the clockwise torque on switch control lever 57 (as viewed from the rear) caused by spring 62, thereby maintaining switch S in its "on" condition. However, after the end of the can has been completely sheared, such thrust no longer exists, and spring 62 then causes control lever 57 (as well as operating lever 27 and cutter mounting plate 20) to rotate to its stable position against stop boss 61, thereby stopping motor M. It is to be noted that at no time is there any physical engagement between resilient can guide 67 and cutter mounting plate 20. If the can opener is also provided with knife sharpening means, it is only necessary for operating lever 27 to be depressed in order to change the switch from its "off" condition to its "on" condition for operating the knife sharpening means. The conventional can guard 22 maintains the side wall of a can at the desired angle relative the face of the can feed wheel 16.

To remove the permanently together assembled operating lever 27 and cutter mounting plate 20 (as for cleaning), it is only necessary to first fully depress knob 49 and then pull the assembly forwardly from the remainder of the can opener. To reinstall same, cutter mounting plate 20 is held with its upper edge approximately horizontal, operating lever 27 is seated on stud 53, knob 49 is fully depressed, and the assembly is moved rearwardly toward frame 15, with latch stud 31 entering aperture 33 and tapered end stud 53 entering opening 54. Since a portion of latch stud 31 fits into aperture 33 before tapered end stud 53 arrives at frame 15, no difficulty is experienced in causing stud 53 to enter opening 54. It will be noted that only two studs need be aligned with corresponding openings to reinstall the assembly on the frame. This permits easy reinstallation, there being no necessity for providing a separate means to rotationally position lever 27 relative to cutter mounting plate 20 in order to assure proper alignment of the studs with their appropriate openings.

As recited in U.S. Pat. No. 3,496,635 (issued Feb. 24, 1970), spring 38 performs three different function. First, it urges latch 42 upwardly at all times. Second, it urges latch 42 to rotate clockwise (as viewed from the rear) at all times. Third, it urges the upper end of latch 42 toward boss 45 at all times. Upward and downward movement of latch 42 is positively limited by engagement of shoulder screw 40 with the respective lower and upper ends of slot 47.

Spring 62 must have sufficient strength to accomplish the automatic shutoff when the end has been completely severed from the can, but not enough strength to move stud 53 upward from the lower edge 66 of rectangular opening 54 while the end of the can is being cut. The preferred strength of spring 62 is such that it exerts a force on control lever 57 midway between the minimum force required to accomplish the automatic shutoff (after the end has been completely sheared from the can) and the maximum force the spring could exert without moving the parts from their can end shearing positions while the end is being sheared from the can. Since the present invention minimizes the friction between the affected moving parts, a spring of reduced tension can be utilized for causing automatic shut-off. Because of the reduction in tension of spring 62, less downward force on operating lever 27 is required to energize the motor for the knife sharpening means alone.

It is preferred that the compound angling of the axis of the cutter wheel 24, and the lateral orientation of cutter wheel 24 relative to can feed wheel 16 (while the end is being sheared from the can), be as shown in U.S. Pat. No. Re-26,074 (issued Sept. 6, 1966). The advantages of such an arrangement (recited in the '074 patent) include the much desired result that the axis of the can is automatically ahead of the axis of the can feed wheel 16 as the end of the can is pierced by the cutter wheel 24. This causes the can to be guided with respect to the can feed wheel 16 in such a manner as to urge the can feed wheel 16 to remain under the edge of the flange of the can, rather than escaping therefrom.

From the foregoing, it will be seen that this invention is one well adapted to attain all of the ends and objects hereinabove set forth, together with other advantages which are obvious and which are inherent to the structure.

It will be understood that certain features and subcombinations are of utility and may be employed without reference to other features and subcombinations.

As many possible embodiments may be made of the invention without departing from the scope thereof, it is to be understood that all matter herein set forth or shown in the accompanying drawings is to be interpreted as illustrative and not in a limiting sense.

Having described my invention, I claim:

1. In a power operated can opener, the combination of:

an upright frame having a bearing opening therein;

a can feed wheel rotatably supported on said frame;

a motor drivingly connected with said can feed wheel;

a switch connected with said motor, said switch having a motor energized condition and a motor deenergized condition;

a cutter mounting plate;

a cutter member mounted on said cutter mounting plate;

an operating lever;

means for pivotally connecting said operating lever to said cutter mounting plate at a location offset from said cutter member;

a first can guide extending forwardly from said cutter mounting plate, said first can guide being coaxial with said pivot connection;

a first pin member extending rearwardly from said operating lever into said bearing opening, said first pin member being cooperatingly positional within said bearing opening in said frame to pivotally support said connected cutter mounting plate and operating lever on said frame, said first pin member being offset from said pivot connection whereby selective pivotal movement of said operating lever with respect to said frame effects movement of said cutter mounting plate throughout an operating range of the latter;

a second pin member extending rearwardly from said cutter mounting plate at a location thereon to move in a path inclined substantially from horizontal upon movement of said cutter mounting plate;

a second opening in said frame, said second pin member extending through said second opening when said connected cutter mounting plate and operating lever are supported on said frame;

a link member pivotally supported on said frame;

means for biasing said link member in a preselected pivotal direction;

a second can guide secured to said link member and extending forwardly beyond said frame at a location remote from said cutter mounting plate as same moves throughout its operating range, said second can guide and cutter mounting plate thereby remaining completely disassociated and out of contact with one another regardless of the position of said cutter mounting plate;

an integral motor control lever mounted for movement on said frame and having a pin engaging edge oriented at an angle from horizontal corresponding substantially to said inclined path of movement of said second pin member, said second pin member being in operable contact with said pin engaging edge to move said motor control lever in a direction to engage same directly against said switch to cause the energization of said motor and the driving of said can feed wheel when said operating lever is moved downwardly from the position in which said cutter member first contacts the end of a can inserted with its flange over the periphery of said can feed wheel; and a latch, said latch releasably engaging said first pin member through said bearing opening to hold said connected cutter mounting plate and operating lever at a position near said frame, and said latch being movable to allow disengagement from said first pin member and axial separation of said first pin member and said bearing opening.

2. The invention of claim 1, including two bosses on said frame and one boss on said cutter mounting plate, means for urging said bosses into corresponding contact with said plate and said frame, said combined three bosses providing low-friction contact points between said frame and said cutter mounting plate, said urging means exerting a contacting force upon said cutter mounting plate within a triangle defined by lines between said three bosses whenever said cutter mounting plate is in any operating position.

* * * * *